United States Patent [19]

Hohorst

[11] 4,171,861

[45] Oct. 23, 1979

[54] ELECTRICAL DISTRIBUTION AND/OR CONNECTION DEVICE

[75] Inventor: Wolfgang Hohorst, Minden, Fed. Rep. of Germany

[73] Assignee: Wago-Kontakttechnik GmbH, Minden, Fed. Rep. of Germany

[21] Appl. No.: 825,064

[22] Filed: Aug. 16, 1977

[30] Foreign Application Priority Data

| | | | |
|---|---|---|---|
| Aug. 18, 1976 | [AT] | Austria | 6144/76 |
| Nov. 12, 1976 | [DE] | Fed. Rep. of Germany | 2651589 |
| Feb. 16, 1977 | [DE] | Fed. Rep. of Germany | 2706482 |
| Apr. 20, 1977 | [DE] | Fed. Rep. of Germany | 7712331[U] |

[51] Int. Cl.[2] ..... H01R 9/00

[52] U.S. Cl. ..... 339/198 G; 339/198 GA

[58] Field of Search ..... 339/198 G, 198 GA, 198 H

[56] References Cited

U.S. PATENT DOCUMENTS 3,852,703 12/1974 Carney et al. ..... 339/198 H

*Primary Examiner*—Roy Lake
*Assistant Examiner*—DeWalden W. Jones
*Attorney, Agent, or Firm*—Lawrence E. Laubscher

[57] ABSTRACT

Electrical distribution and/or connection devices include an electrically connecting bridge having two contact limbs with respective contact points for the connection of respective electrical conductors. The contact points may comprise spring clamps. The devices may be formed for mounting in line on a rail and may be formed for the connecting bridge of adjacent devices to be interconnected by a removable bridge component which has two contact limbs for engaging the respective said connecting bridges at web portions thereof disposed between the respective contact points.

17 Claims, 29 Drawing Figures

ELECTRICAL DISTRIBUTION AND/OR CONNECTION DEVICE

STATEMENT OF THE INVENTION

The invention relates to an electrical terminal or connecting device such as terminal blocks for switchgear, terminal strips or other terminal or connecting means.

SUMMARY OF THE INVENTION

The object of the invention is to provide an electrical terminal or connecting device which is simple in construction and safe and easy to handle.

A further object is to provide a bridging device for such electrical terminal or connecting devices which, as a cheap mass-produced part, permits the bridging of any desired number of terminals with a single part, without special precautions, in combination with the associated electrical terminal or connecting devices, such as terminals and so renders possible an electrical circuit in the form of a current distribution between any desired number of electrical conductors.

It is a further object of the invention to improve a terminal or connector and to give the clamping spring, as a self-supporting component, an increased contact force with as long a spring excursion as possible.

It is a further object of the invention to construct the earth-wire bridge, which serves for the earthing to a supporting rail on a terminal block in such a manner that by simply pressing in or pushing in on a marginal strip of the supporting rail, without the aid of a tool, the terminal housing can be reliably secured and earthed or the terminal housing can be removed from the supporting rail by gentle pulling likewise without an additional tool.

A further object lies in a stable construction of the contact bridge and of the clamping spring(s), and the terminal should be made small in volume but nevertheless permit high contact pressures.

It is a further object of the invention to provide a terminal housing for such terminals and connectors with a locking means which renders possible a simple and easy assembly and detachment, which can be carried out rapidly, of individual terminal housings without alteration of the position (displacement) of the other terminal housings.

BRIEF DESCRIPTION OF THE DRAWING

Examples of embodiment of the invention are illustrated in the drawings.

DETAILED DESCRIPTION

Figure 1:
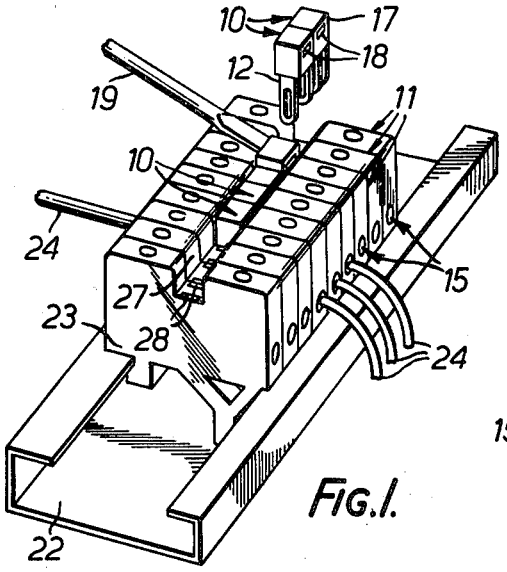
FIG. 1 shows a perspective view of a plurality of electrical terminals and bridges connecting these electrically, in the connected and detached position.
Figure 3:
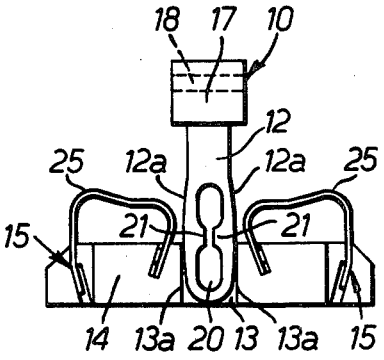
FIG. 3 shows a side view of a terminal web with inserted bridge.
Figure 2:
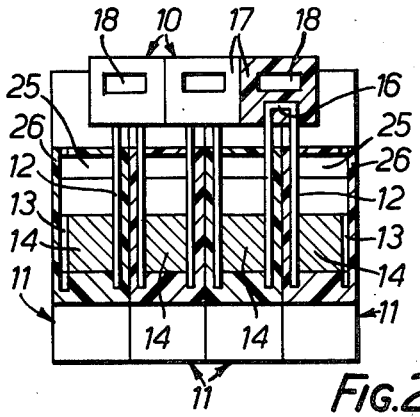
FIG. 2 shows a vertical cross-section through the terminals with bridges inserted.

According to FIGS. 1 to 11, an electrical bridge according to the invention is designated by 10 with which two electrical terminal and/or connecting devices 11, such as screwless terminals, screw terminals, electrically conducting parts or the like can be electrically connected to one another.

This bridge 10 is made U-shaped and is detachably held, with a plug-in connection by its two U-arms 12 in recesses 13 in two contact webs 14 of the terminal and/or connecting device 11, outside the contact points (conductor connection points).

In a preferred manner, the bridge 10 is formed from a U-shaped member; its two U-arms 12 represent the electrical connecting contacts with the U-web 16 and in the region of the U-web 16, the bridge 10 is provided with an insulating head 17 as a handle head (portion to grasp).

The U-shaped bridge 10 may advantageously be produced from a flat strip of electrically donducting material such as steel, copper, brass or another suitable material. Its two U-arms 12 and also the U-web 16 have a rectangular cross-section and the larger rectangular extent of this cross-section extends transversely to the longitudinal direction of the arms and so determines the width of the U-shape.

The web can be made extending at an angle, such as a right angle, to the arms 12 or may be arcuate; the two arms 12 preferably extend parallel to one another and are equal in length. The handle head 17 is made of insulating material, preferably synthetic plastic material and is provided round the U-web 16 and the adjacent longitudinal end regions of the arms 12—this handle head 17 is preferably injection-moulded round the U-web 16 and the arms 12 and so connected to the U-shaped member 12, 16 during production.

The handle head 17 has an angular shape, for example the shape of a cube or rectangular block, or is constructed in the form of a cylinder member.

The two longitudinal edges 12*a* of the two arms 12, which limit the width of the arms, are contact surfaces which cooperate with the recess edges 13*a* of the recesses 13.

Figure 5:
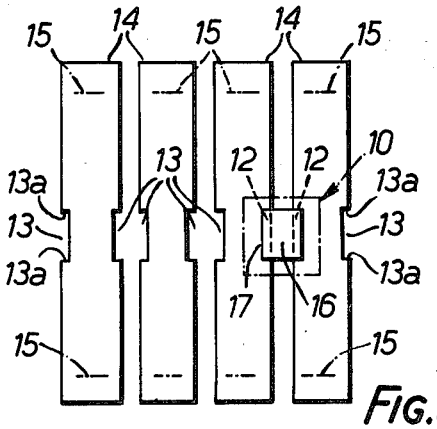
FIG. 5 shows a plan view of a plurality of terminal webs with lateral grooves for the pins of the bridge and a bridge connecting two webs.
Figure 6:
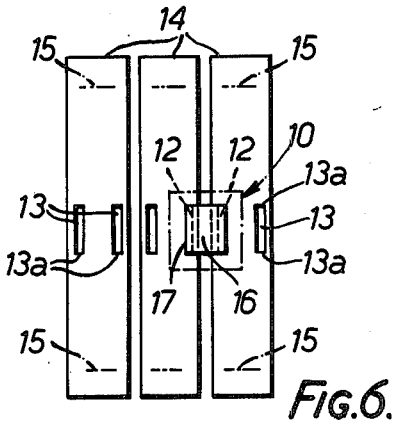
FIG. 6 shows a plan view of a plurality of terminal webs with slots hollowed out for the pins of the bridge and a bridge connecting two webs.

As illustrated in FIG. 5, the recesses 13 may be formed by grooves which are made in the contact web 14 from the two laterial longitudinal edges of the contact web 14 and the edges of which, determining the width of the groove, provide the contact surfaces 13*a*. In the further embodiment shown in FIG. 6, the recesses 13 are formed by slots which are formed in the contact web 14 at a distance from the two lateral longitudinal edges and extend with their longitudinal direction in the longitudinal direction of the contact web; in this case, the end edges of the slots form the contact surfaces 13*a*.

The grooves 13 and slots 13 each have a rectangular basic shape and receive an arm 12 at least substantially positively, the electrical contact with the arms 12 at the edges 13*a* being made mainly by their longitudinal edges 12*a*.

The depth of the groove-shaped recesses 13 preferably corresponds to the thickness of the arms 12 so that, in the inserted state, these extend flush with the longitudinal edges of the web 14 with their internal broad side adjacent to the other arm 12.

A release opening 18, such as a groove, aperture, depression or the like is formed in the insulating head 17, in which a tool 19, preferably a screwdriver, can be fitted, with which the bridge 19 can be detached from its plug-in connection.

The aperture 18 extends parallel to the width of the arm and when constructed in the form of a groove or depression a release opening 18 is formed at each of the opposite faces of the handle portion 17 extending transversely to the U-shape.

In order to achieve a satisfactory contact pressure between the longitudinal edges 12*a* of the arms and the edges 13*a* of the recesses, it is preferable to shape each arm 12; this may appropriately be done by forming a recess 20, such as a slot extending in the longitudinal direction of the arm, in each arm 12 and arching the two longitudinal edges 12*a* convexly outwards in the region of the recess 20 so that the width of the arm 12 is greater in the arched region than the width of the recess 13 and when the arm 12 is inserted in the recess 13, the longitudinal edges 12*a* are reduced in spacing from one another, that is to say are pressed together.

In the region of its aperture 20, each arm 12 has two opposite stops 21 which face one another in the plane of the arm and which limit the spring excursion of the bent out edges 12*a* in relation to one another so that when the stops 21 strike together there is still a clamping pressure of the longitudinal edges 12*a* against the recess edges 13*a*. The bridge 10 according to the invention serves in particular for the electrical connection of the contact webs (contact bridges) 14 of screwless terminals 11 which are formed individually side by side to form a block or are constructed in the form of a prefabricated single block and can be located on a supporting rail 22.

These terminals 11 in their terminal housing 23 have the contact web 14 and one, two or more clamping springs 25 which are held thereon under tension and form, between themselves and the contact web 14, the gripping points 15 for the electrical conductor 24 to be connected up. The gripping points 15 are situated at opposite sides of the terminal housing 23 and the bridge 10 is inserted at an angle, preferably at a right-angle to the direction of introduction of the conductor in the terminal housing 23 and two recesses 13 of two adjacent contact webs 14.

With individual terminals 11 placed side by side, each contact web 14 is insulated in the housing 23 and the housings 23 lie with lateral dividing walls 26 against one another so that a bridge 10 engages with its two arms 12 over two adjacent dividing walls of the two adjacent housings 23. When the terminals 11 are constructed in the form of a one-piece block, there is only one dividing wall 26 between two adjacent contact webs 14 over which wall the U-arms 12 of the bridge engage.

Each terminal block 11 contains a groove 27 at the top in which the insulating head 17 of each bridge 10 engages and extends substantially flush with the top of the terminals 11 with its upper face. In the bottom of the groove there are recesses 28 through which the arms 12 engage in the housing 23 for the electrical connection of two adjacent terminals 11.

Each bridge 10 can be pressed by hand into two adjacent terminals 11 and engages with its two arms 12 in the recesses 13 of adjacent contact webs 14 so that the electrical connection is established as a result. The detaching of the inserted bridge 10 is preferally carried out by means of a screwdriver 19 which is introduced obliquely from above into the release opening 18 of the required bridge and then pulls the bridge 10 out upwards by lever action (supporting the screwdriver 19 on the top of the terminal).

When the bridge 10 is inserted, the necessary air passages and creepage paths are retained unaltered through the dividing walls 26.

The spacing of the adjacent grooves 13 or slots 13 is the same in all the terminals 11 so that only one type of bridge is necessary for the terminal connection and this can be used universally.

The bridge 10 can also be used for screw terminals or other electrical terminal and/or connecting devices.

Figure 4:
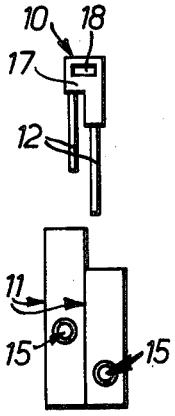
FIG. 4 shows an end view of two terminals of different height with a detached bridge having pins of different length.

FIG. 4 shows a modified construction of a bridge 10 which in this case has U-arms 12 of different length so that an electrical connection of terminals 11 of different height or the like is possible with this bridge 10.

Figure 7:
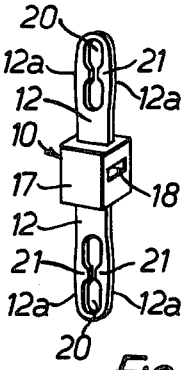
FIG. 7 shows a perspective view of a bridge in a further embodiment.

FIG. 7 shows a bridge 10 with arms 12 extending in opposite directions from the insulating head 17 so that this bridge 10 permits an electrical connection between two terminals 11 or the like disposed one above the other, the one arm 12 being inserted from below in the upper terminal 11 and the other arm 12 being inserted from above in the lower terminal 11. This bridge 10 having two arms 12 extending in rectilinear extension can also be used for the lateral connection of two terminals 11.

It also comes within the scope of the invention to slit the arms 12 of the bridge 10 from their free longitudinal end, in order to increase the spring action.

In a further form of embodiment, not illustrated, the bridge 10 is equipped with arms 12 which are angular, circular or oval in cross-section, and which are hollow in order to achieve the spring action and are inserted in corresponding recesses in the webs 14; in this case, the recesses may be formed by angular, circular or oval holes and be situated diagonally in relation to one another in each web 14 so that the bridges 10 connect the two adjacent webs 14 in an oblique position, that is to say the two arms 12 of the bridge lie spaced apart on a line which extends obliquely to the longitudinal direction of the contact webs 14.

Figure 8:
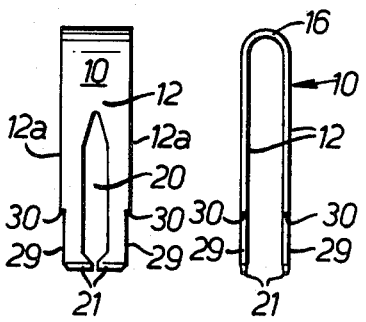
FIG. 8 shows two views of a bridge without insulating head and with insertion stops provided on the pins.

In order to render possible easy insertion of the bridges 10, their arms 12 are rounded and/or bevelled at the free ends in the direction of width and/or thickness. The bridge 10 according to the further embodiment of FIG. 8 is formed from a U-shaped member and has no insulating head 17. This bridge 10 is inserted so far into two terminals 11 to be bridged that its U-web 16 lies below the top of the terminals and so is inserted with reliable contact and electrically reliably for the bridging.

Each arm 12 is made resilient by a recess 20 introduced into the arm 12 in the longitudinal direction from the free end of the arm and occupying a portion of the length of the arm, and this recess 20 forms two opposite stops 21, facing one another at the free end of the arm to limit the spring excursion of the arm.

Furthermore steps (reliefs) 29 are provided at the two longitudinal edges **12*a* of the arms 12 from the free end over a portion of the length of the arm, and form an insertion limiting stop 30 in the longitudinal direction of the arm spaced apart from the free end of the arm so that the insertion depth of the bridge 10** is limited when the bridging is effected.

A so-called snap effect occurs with this embodiment when the bridge 10 is inserted because, as a result of the resilient arms 12, these are compressed as far as the stop 21 and can then be inserted and are fully inserted when the stops 30 strike against the contact bridge 14 (upper edge) and not further insertion can be effected.

In this embodiment, the contact points are formed by the longitudinal edges of the recess 29 which extend from the free end of the arm to the stop 30.

The recess 20 extends, in length, beyond the stops 30 and is shuttle-shaped in plan view.

Figure 9:
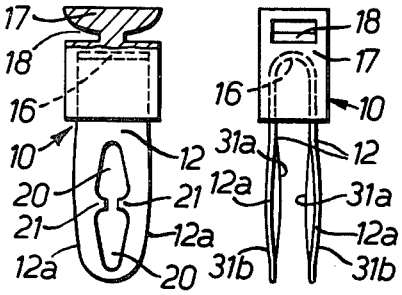
FIG. 9 shows three views of a bridge with insulating head and shaped pins.

FIG. 9 shows a bridge 10 with an insulating head 17 in which a groove is provided as a release opening 18 at each of two opposite sides, above the web 16. The two recesses 20 forming the stops 21 in the arms 12 are substantially pear-shaped with the pointed ends of the pears remote from one another, facing away from the stops 21.

The arms 12 have two outwardly curved longitudinal edges **12*a* as contact points. Each arm is twisted and this twisting is effected in the region of the recesses 20 so that two arm regions 31*a*, 31*b* are formed which are deflected from the plane of the arm in opposite directions as can be seen in cross-section from FIG. 9**.

This bridge 10 as shown in FIG. 9 is particularly suitable for bridging contact elements 14 with slots 13 so that, apart from the longitudinal edges **12*a* as contact points, the broad sides of the twisted regions 31*a*, 31*b*** of the arms form contact surfaces and so an enlarged contact is made.

Figure 10:
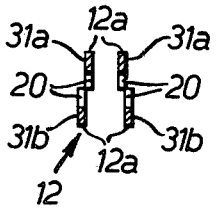
FIG. 10 shows three views of a bridge with formed-out portions on the pins.
Figure 10:
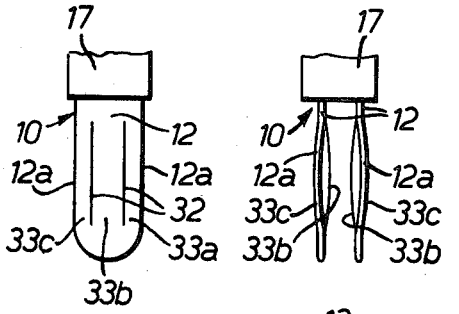

The bridge 10 of FIG. 10 is also adapted for inserting its arms 12 in slots 13 in the contact members 14 and achieves a larger contact area.

In this case, the two arms 12 are made without recesses and are each provided, in the longitudinal direction, with two parallel slits (incisions) 32 beginning spaced apart from the free end of the arm and ending spaced apart from the insulating head 17, and dividing each arm 12 into three regions **33*a*, 33*b*, and 33*c*, situated side by side and extending in the longitudinal direction of the arm; the central region 33*b* of the arm is bent out of the plane of the arm and the other two regions 33*a* and 33*c*, which lie in one plane, are likewise bent out of the plane of the arm in the opposite direction to the central region 33*b*, as can be seen in FIG. 10. The two arms 12 are provided with their central regions 33*b* facing one another; as a result of these deformed regions 33*a*, 33*b*, 33*c*, each arm 12 forms contact areas in the slots 13 with the broad side, apart from its longitudinal edges 12*a***.

Figure 11:
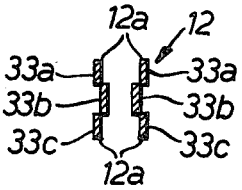
FIG. 11 shows a side view of a terminal with resilient terminal webs for the bridge pins of rigid construction.
Figure 11:
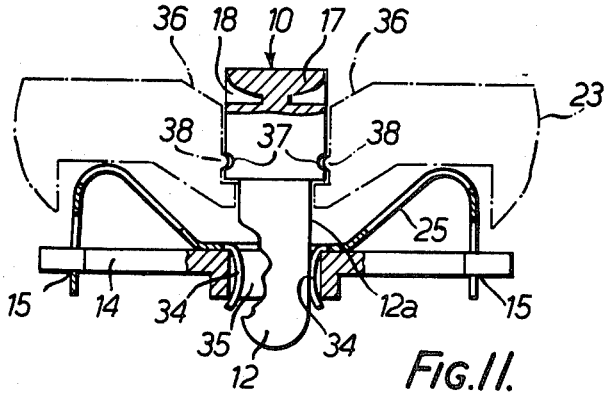

According to the further embodiment as shown in FIG. 11, the bridge 10 is provided with rigid arms 12; thus the arms 12 are made without recesses 20 and so form rigid contact points with the two longitudinal edges **12*a***.

Disposed on the contact bridge 14 is a one-piece, bent clamping spring 25 which preferably forms two clamping limbs and which engages through a recess 35 in the contact bridge 14 with shaped webs 34 in the central longitudinal region. The webs 34 are made arcuate in the longitudinal direction and so engage round the contact bridge 14 in the region of the recess 35 and engage under the contact bridge 14, as a result of which the clamping spring 25 is located on the contact bridge 14 and no further aids are necessary for securing the clamping spring 25 to the contact bridge 14. The bent webs 34 have a certain freedom of movement in the recess 35 and form contact and gripping points for the bridge arms 12 apart from the clamping spring attachment. When the ridge arm 12 of the bridge is inserted between the two webs 34 curved convexly in relation to one another, the rigid longitudinal edges **12*a* of the arms 12 urge the webs 34 apart in the direction of the edge of the recess 25 so that, as a result, a satisfactory contact pressure develops between the bridge arm 12 and the clamping-spring webs 34 and at the same time the location of the spring 25 on the bridge 14 is further increased because the webs 34 are urged against the contact bridge 14 in the region of the recess 35**.

As can be seen from FIG. 11, it is preferred to provide the terminal housing 23 with bevels 36 at each side of the insulating-head receiver 27, which bevels extend towards the release openings 18 in the insulating head 17 and facilitate the lifting out of the bridge 10 by means of a screwdriver 19.

Furthermore, a securing means for the inserted bridge 10 is illustrated in this Figure; this can be achieved by the fact that the insulating head 17 is provided with grooves 37 in which detents 38 injection-mouled on the housing 23 of insulating material engage in the inserted position and prevent the inserted bridge 10 from accidentially shaking loose.

When the terminals 11 disposed one above the other are bridged by the bridge 10 as shown in FIG. 7, the housings 23 of insulating material have receivers (not illustrated) at their top and bottom for the bridge 10 and its insulating head 17.

In FIGS. 12 to 16 a housing of insulating material, open at one side, of a terminal and connector is designated as a switchgear line-up terminal, the resiliently flexible feet 41 of which engage round a rail 42 on which a number of these line-up terminals can be disposed side by side.

These resilient feet 41 may also serve for connection to another corresponding line-up terminal, situated below, these feet engaging behind corresponding projections 43 at the upper end of the adjacent line-up terminal.

A terminal device constructed in the form of a self-supporting structural unit is pushed laterally, from the open side, into the interior of the housing 41 of insulating material. Its contact bridge 44 is made U-shaped in cross-section (see FIG. 15), its lateral arms being provided with holes 45 in which pins 46 injection-moulded on the side wall of the housing 40 of insulating material and projecting into the interior engage to locate the contact bridge in the housing 40 of insulating material.

The web 44*a* between the two arms 44*b* of this contact bridge 44 is bent at the end to form a depression 44*c* which is stamped out in the form of a tab and open at the top and in which an angled portion 48*a* of a clamping spring 48 engages. This clamping spring 48 is bent substantially in the form of a loop and closed on itself in such a manner that one of its arms 48*b*, which ends in the above-mentioned angled portion 48*a*, bears against the web 44*a* of the contact bridge 44, parallel thereto, and is secured against displacement in the longitudinal and transverse direction by a collar rivet 47 (through a hole 49 in the arm 48*b*). This collar rivet 47 is formed out of the web 44*a* of the contact bridge 44.

The arm 48*b* of the clamping spring 48 is at an acute angle to a further arm 48*c* which forms an open angle with the contact bridge 44. For this purpose, the central portion (the web) of the clamping spring 48 is bent twice and offers a long travel to the clamping spring 48 through a central portion 48*d* bent in the opposite direction. As a result of these lateral bends merging into the arms 48*b* and 48*c* and the opposite bend 48*d*, the clamping spring has a high clamping force so that the arm 48*c*, through the contact-bridge aperture 48*e* of which the angled portion 48*a* of the other arm 48*b* engages, presses an inserted conductor 50 with high tension against the under side of the contact bridge 44.

In the course of this, the depression 44*c* forms a linear contact surface at its under side so that a clamping edge 48*f* of the arm 48*c* under tension grips the conductor 50 passed through the aperture 48*e* particularly firmly at the under side of the contact bridge 44.

For this purpose, it may be preferred for the arm 48*c* underneath the contact bridge 44 to be equipped with a spring tongue 48*g*, the free clamping edge of which, when a conductor 50 is inserted, together with the bent under surface of the depression 44*c* grips the conductor 50 in such a manner that there is a certain spacing in the longitudinal direction of the contact bridge 44, between the depression 44*c* and the clamping edge of the spring tongue 48*g*. This construction is suitable not only for rigid conductors but also, in particular, for conductors of fine wire because the fine wires then bend substantially in the form of an S round the under surface of the depression 44 and the clamping edge of the spring tongue 48*g*. As a result, accidental pulling out of the conductor 50 is prevented in an advantageous manner because the clamping force between clamping spring and contact bridge is very high. Only after the clamping spring 48 has been pressed down in its bent central region is it possible for the clamping edge 48*f* of the spring tongue 48*g* to be removed downwards from the contact bridge so that only then can the conductor 50 be pulled out. For this purpose, an aperture 51 is provided in the insulating housing 40, through which a pressing device such as a screwdriver can be introduced in order to press the clamping spring downwards.

The depression 44*c* and the spring tongue 48*g* form a funnel which facilitates the guiding of the inserted conductor 50.

Figure 12:
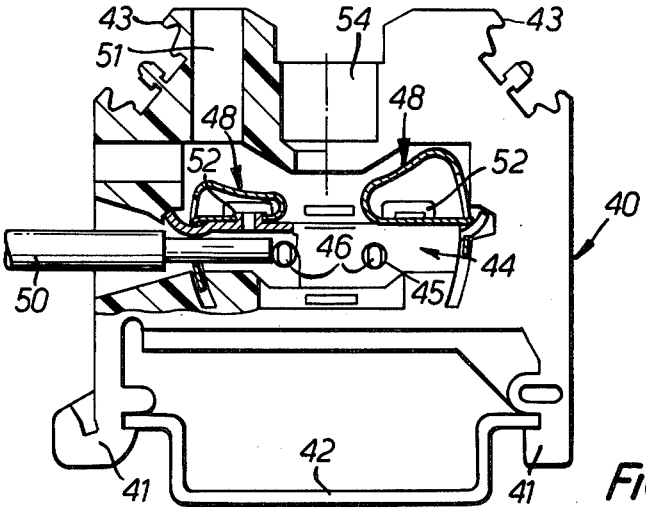
FIG. 12 shows a terminal block for switchgear in side elevation and partially with a terminal device inserted therein consisting of a contact bridge and clamping springs secured thereto.
Figure 13:
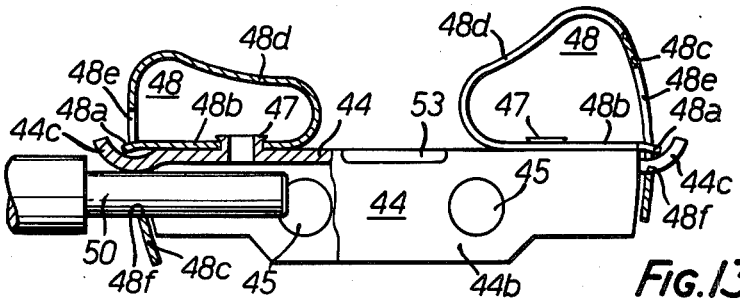
FIG. 13 shows an enlarged illustration of the terminal device.
Figure 14:
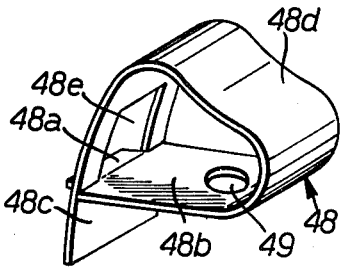
FIG. 14 shows a perspective view of a clamping spring closed in the form of a loop.
Figure 16:
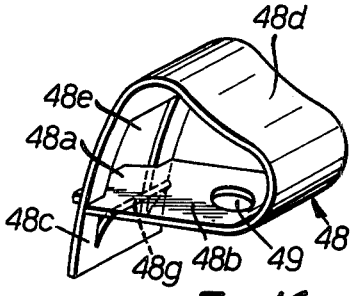
FIG. 16 shows a clamping spring bent in the form of a loop with a spring tongue.
Figure 15:
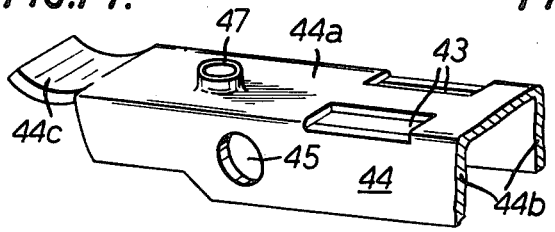
FIG. 15 shows a contact bridge bent in U-shaped.
Figure 17:
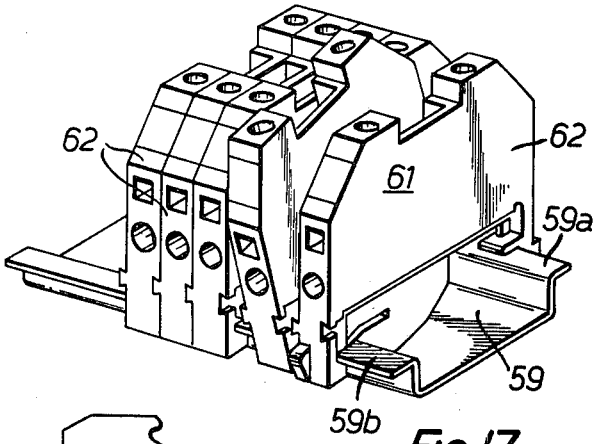
FIG. 17 shows, in a perspective view, a plurality of line-up terminals combined to form a block on a supporting rail.

In the illustration if FIGS. 12 and 13, two clamping springs 48 are secured in mirror image to the common bridge 44.

Instead of a rivet connection between contact bridge 44 and the arm 48*b* of the clamping spring, it is also possible to mould pressure members 52 on the housing which project into the interior of each clamping spring, press the arm 48*b* against the contact bridge 44 in each case and prevent the clamping spring 48 from being pressed down too low.

This contact bridge 44 may, for example, comprise two slots 53 through which one arm of each of two adjacent straight or U-shaped bridges (not illustrated) can be inserted in order to connect adjacent terminal devices electrically to one another. These bridges are pushed through the opening 54 in the insulating housing and, because of their U-shaped, hold two adjacent insulating housings 10 against one another or in a straight line one above the other.

The closed construction of the clamping spring 48 with interengaging spring arms 48*a* and 48*c* has the advantage that these support one another independently without additional securing. As a result of the interengagement and the associated support of the clamping spring, the tilting moment occurring on actuation of the clamping spring is reduced.

The bend inside the central portion of the clamping spring 48 bent in the form of a loop causes a greater reserve of force as a result of a flat characteristic curve. Also, such a clamping spring can be pushed over the contact bridge very easily in the mounting direction during mounting, but then cannot easily be detached again.

As a result of the provision of a depression, the conductor inserted in the terminal device has a predetermined contact point or contact line which does not alter even in the event of a possible tumbling movement of the conductor. Also the specific contact pressure remains comparatively high and constant at this contact point.

Figure 18:
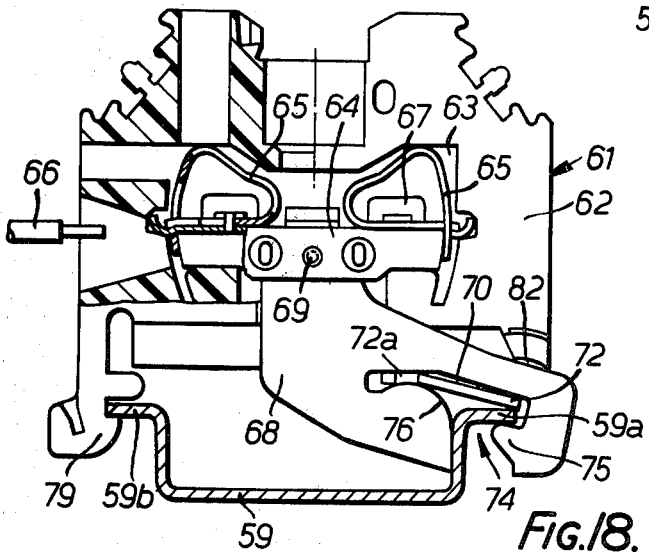
FIG. 18 shows a side view, partially in longitudinal section, of a line-up terminal located on a U-shaped supporting rail.
Figure 20:
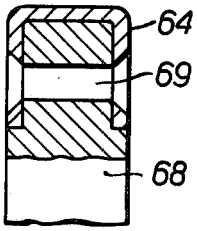
FIG. 20 shows a cross-section through a contact bridge of the line-up terminal with ground-wire bridge screwed therein.
Figure 19:
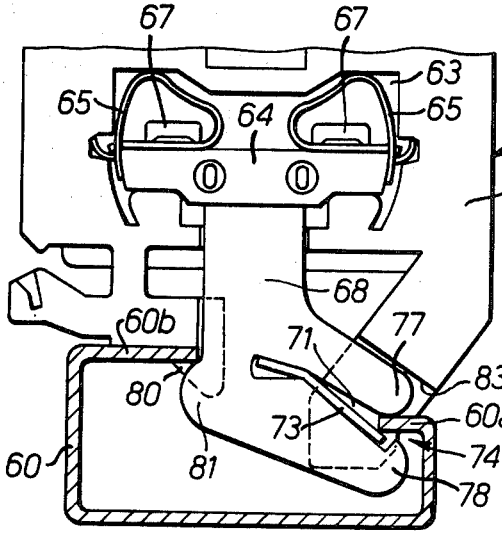
FIG. 19 shows a side view of a modified line-up terminal on a U-shaped supporting rail.

According to FIGS. 17 to 20, a plurality of electrical line-up terminals 61, the purpose of which is to connect electrical conductors to one another, and which are combined to form a block are located on a supporting rail 59 of U-shape (FIGS. 17 and 18) or 60 of C-shape (FIG. 19).

For this purpose, each line-up terminal 61 has an insulating housing a terminal housing 62, which has a receiving space 63 for a contact bridge 64 and two clamping springs 65 cooperating therewith for the electrical connection of two electrical conductors 66 introduced from opposite ends.

The contact bridge 64 is preferably made U-shaped in cross-section with arms extending downwards; its upper web forms a contact surface for the arms, extending parallel thereto, of each clamping spring 65 directed oppositely to one another. Both the contact bridge 64 and the clamping springs 65 are held against displacement in the terminal housing 62 by means of projections 67 which are formed out of the terminal housing 62 and project into the receiving space 63.

In order to ground such a line-up terminal 61 (E), a ground-wire bridge 68 of electrically conducting material is secured to the contact bridge 64, for example by means of rivets, screws 69, which engage through the end of the ground-wire bridge 68 at the contact bridge side and through the web of the contact bridge 64 (FIGS. 18 and 20) or by means of soldering, welding or the like (FIG. 19), the conducting connection being able to be produced by frictional connection.

The ground-wire bridge 68 shown in FIGS. 18 and 19 is rigid in itself and has, at its free end a clamping groove 70 (FIG. 18) or 71 (FIG. 19) in which a marginal strip 60*a* of the supporting rail of 59*c* of the supporting rail 59 engages. This clamping groove 70 and or 71 extends substantially parallel to the supporting rail 59 or 60 so that its marginal strip 59*a* or 60*a* is held in the clamping groove 70 and 71 with as broad an area as possible. In order to construct this clamping groove 70 and 71 so that it has a resilient effect for the marginal strip 59*a* or 60*a*, a leaf spring 72 lies in the clamping groove 70 and 71 and, because of its angled shape, presses the marginal strip 59*a* and 60*a* against a wall of the clamping groove 70 or 71 with a tightening action. The free end of the ground-wire bridge 68 comprising this clamping groove 70 or 71 is provided with rounded portions 75, 76 (FIG. 18) or 77, 78 (FIG. 19) at both sides in the region of the slot 74 in the clamping groove 70, 71 so as to permit a pivotal movement of the terminal housing 61 when it is fitted in such a manner that first the terminal housing with the ground-wire bridge 69 is pushed over the marginal strip 59*a* or 60*a* and then can engage with an opposite foot-like extension 79 (FIG. 18) or 80 (FIG. 19) on the opposite marginal strip 59*b* or 60*b* of the supporting rail 59 or 60 so that the terminal housing 62 and hence the whole line-up terminal 61 is located on the supporting rail 59 and 60 at both sides.

The foot-like extension 79 or 80 of the terminal housing 62 may be made resilient in itself so as to compensate for tolerances either in the width of the supporting rail 59 or 60 or in the spacing of the clamping groove 70, 71 from the foot-like extension 79, 80 and also to facilitate the engagement of the marginal strip 59*b* or 60*b* in the holding slot in the extension 79, 80.

The angled leaf spring 72 or 73 can be secured in its position in the clamping groove 70, 71 by the fact that the projection 76 bears against the flat spring 72 in its angled region. In this case, the edge 72*a* of a recess formed in the flat spring can form an abutment surface with respect to the projection, thus preventing an unwanted longitudinal displacement of the angled flat spring 72.

Either a U-shaped supporting rail 59 (FIGS. 17 and 18) with marginal strips 59*a* and 59*b* bent outwards at an angle or a C-shaped supporting rail 60 (FIG. 19) with the marginal strips 60*a*, 60*b* which are bent inwards at an angle can be used.

In the form of embodiment illustrated in FIG. 19, the ground-wire bridge 68 comprises a projecting rounded nose 81 at its free end, opposite the clamping groove 71, through which nose the ground-wire bridge 68 is additionally engaged in relation to the marginal strips 60*b* of the supporting rail 60 above the nose 81 and so is better held against displacement.

In order to fit the line-up terminal 61, the terminal housing 62 is first brought obliquely from above to the supporting rail 59 or 60 and then pushed with the clamping groove 70 or 71 over the marginal strip 59*a* or 60*a*. Then the line-up terminal is pivoted so that the contact bridge 64 is aligned parallel to the supporting rail 59 or 60. In the course of this, the foot-like extension 79 or 80 engages resiliently round the other marginal strip 59*b* or 60*b*, so that the terminal housing 62 is firmly engaged on the supporting rail 59 or 60 and is held against displacement so that it engages with a reliable ground-wire connection.

In order to detach the line-up terminal 61, the terminal housing 62 is pivoted in the reverse direction so that first the foot-like extension 79 or 80 (also the nose 81 in the embodiment as shown in FIG. 19) is detached from the supporting rail 59 or 60 and then, on further pivoting of the terminal housing 62, the free end of the ground-wire bridge 69 is also detached from the marginal strip 59*a* or 60*a*.

Abutment surfaces 82 (FIG. 18) or 83 (FIG. 19), which prevent the free end of the earth-wire bridge 68 from escaping upwards, are provided in the terminal housing 62, in the region of the clamping groove 70, 71 of the ground-wire bridge 68.

Thus in order to mount and locate a line-up terminal 61 on a supporting rail 59 or 60 or to remove a line-up terminal, with the construction according to the invention of a line-up terminal ground-wire bridge 68 or the like with a clamping groove 70, 71 having a resilient action, no tool, such as a screwdriver is needed because the automatic engagement is effected between terminal housing 62 with ground-wire bridge 68 on the one hand and a foot-like, preferably resilient extension 79, 80 on the other hand, on the supporting rail 59, 60 which may have various shapes.

It is also within the scope of the invention to make the end of the ground-wire bridge at the supporting rail side resilient in itself, as regards material, so that the insertion of a flat spring or the like as an aid to gripping in the clamping groove is superfluous.

According to FIGS. 21 to 24, a contact bridge is designated by 90 and a clamping spring of a screwless terminal and/or connector for electrical conductors 93 is designated by 91 or 92; the clamping spring 91 or 92 is held on the contact bridge 90 under tension and forms at least one clamping point 94 for the electrical conductor 93 with the contact bridge 90.

The clamping spring 91 or 92 is preferably located on the contact bridge 90 with a plug-in connection and is mounted for movement transversely to the direction of insertion of the donductor with its clamping arm 95 in a slot guide 96 in the contact bridge 90; this clamping arm 95 has a recess 97, one edge of which forms a clamping edge 97*a*.

The contact bridge 90 is preferably formed from an elongated rod member with angular, such as rectangular or square cross-section or with a circular or oval cross-section; in another form of embodiment, not illustrated, the contact bridge 90 is formed by a sleeve, such as a length of tube, bush or the like, particularly by a rolled sheet metal member, and has a circular, oval or angular cross-section. Furthermore, the contact bridge 90 may be constructed in the form of a sleeve and have an angular cross-section externally and a circular cross-section internally, or vice versa.

Figure 24:
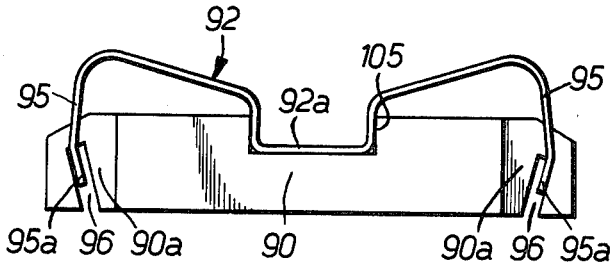
FIG. 24 shows a side view of a terminal with a contact bridge and a clamping spring disposed thereon and comprising two spring arms.
Figure 25:
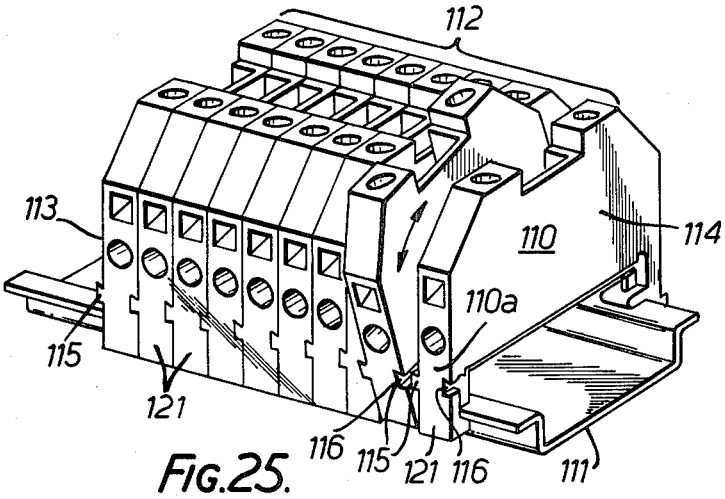
FIG. 25 shows a perspective view of a plurality of terminal housings which are mounted on a supporting rail to form a block and which are held together in the block by interengaging locking devices, with one terminal housing partially detached by pivoting transversely to the longitudinal direction of the rail.
Figure 26:
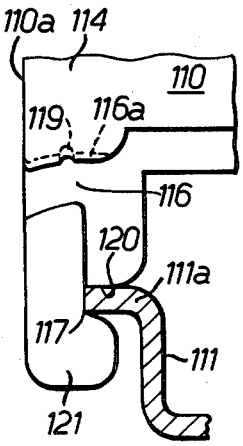
FIG. 26 shows an end view of a portion of the terminal housing with a retaining dog projecting at one side and a retaining recess provided at the other side.
Figure 27:
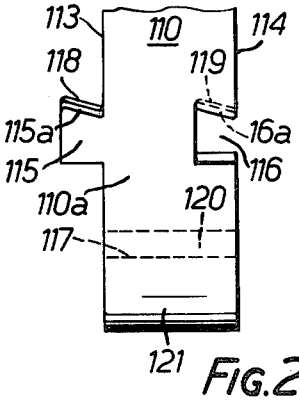
FIG. 27 shows a side view of a portion of the terminal housing with retaining recess.
Figure 28:
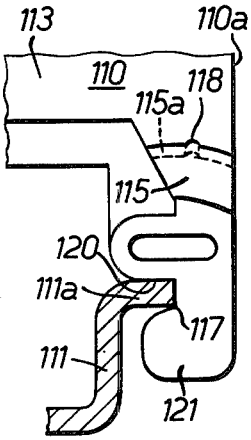
FIG. 28 shows a side view of a portion of the terminal housing with retaining dog.
Figure 29:
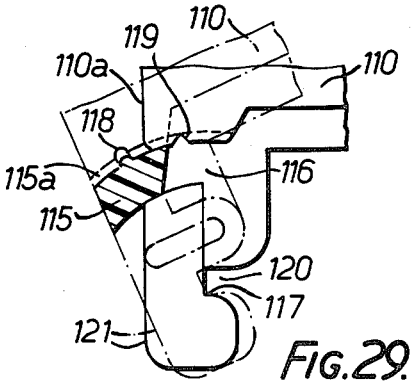
FIG. 29 shows a side view, partially in section, of two terminal housings partially connected to one another by the recess and the dog.

Two individual clamping springs 91, each with a clamping arm 95 are located on this contact bridge 90 in the longitudinal direction of the bridge (FIGS. 21 and 22) or a one-piece clamping spring 12 having two clamping arms 95 is secured (FIG. 24).

Reference will first be made to the embodiment shown in FIGS. 21 to 23.

The contact bridge 90, which may be angular in cross-section for example and be formed by a rod member, receives two clamping springs 91, which are identical in construction and disposed in mirror image, each with a clamping arm 95, in the longitudinal direction of the bridge.

For the location of each clamping spring 91, the contact bridge 90 has a slot 100 which preferably extends over the whole width of the contact bridge 90 and extends obliquely from the upper cross-sectional side in the direction of the clamping arm 95 (towards the free end of the bridge) into the contact bridge 90. The clamping spring 91, which is bent into U-shape, is located in this slot 100 with a securing arm 101 by pushing in and preferably with a press fit. It is preferably to provided at least one raised portion 102 on the securing arm 101, such as a bead, with which the securing arm 101 is held gripped in the slot 100.

The two arms 95, 101 of the clamping spring 91 are at an acute angle to one another and are provided on a channel-like (V-shaped) spring web 103 via rounded portions, the securing arm 101 being made shorter in length than the clamping arm 95. The slot guide 96 in the contact bridge 90 is formed by a slot which extends obliquely upwards from the under side of the bridge 90 towards the free end of the bridge and which occupies the whole width of the contact bridge so that the two slots 96, 100 formed in the bridge 90 from opposite cross-sectional sides for each clamping spring 91 form a V-shape with one another.

A recess 97, the basic shape of which is angular, such as square or rectangular, is hollowed out of the clamping arm 95, its lower edge forming the clamping edge 97*a*. There is the possibility, however, of making the recess 97 circular or oval in basic shape, in which case the lower edge of the recess then forms the clamping edge 97*a*.

Clamping spring 91 and contact bridge 90 preferably have the same width. In this case it is necessary for the contact bridge 90 to be made at the end of its long side in the form of an extension 90*a* which is reduced in cross-section, particularly in width, and which is engaged round by the recess 97.

The slot 96 extends with spacing from the end face of the extension 90*a* and the clamping spring 91 is held by the oblique securing arm 101 with its clamping arm 95 in the slot 96 under a tension which is subjected to bending stress by the U-shape of the spring so that, in the position in which it is not gripping an electrical conductor 93, the clamping spring 91 is in a raised position with its clamping arm 95, in which position the clamping edge 97*a* bears against the bottom of the slot.

An insertion opening 104, such as a blind bore, in which the electrical conductor 93 is inserted to make contact, is made in the contact bridge 90 from the end for each clamping spring 91. In the ungripped state, the free lower end of the arm 95*a* which is bent towards the securing arm 101 for the mobility of the clamping arm 95 in the slot 96, closes the insertion opening 104 in the contact bridge 90. In order to grip an electrical conductor 93, a pressure is exerted downwards (towards the contact bridge 90) on the clamping spring 91 in the region of its clamping arm 95, so that the clamping arm 95 moves in the slot 96 to its side which is open at the bottom and the clamping arm 95 comes with its recess 97 in the region of the insertion opening 104 and frees this for the insertion of an electrical conductor 93 which is then passed through the recess 97. Then the pressure is relieved on the clamping arm 95 and it moves (pivots) upwards again as a result of its tension, in the course of which the clamping edge 97*a* comes under the electrical conductor 93 and grips this between it and the upper wall region of the insertion opening 104—the clamping edge 97*a* and the upper wall region of the insertion opening forms the clamping point 94.

In the longitudinal direction, the insertion opening 104 projects beyond the slot 96 and ends with spacing in front of the securing slot 100.

In the embodiment with a sleeve-like contact bridge, the cavity in the sleeve forms the insertion opening 104.

Figure 21:
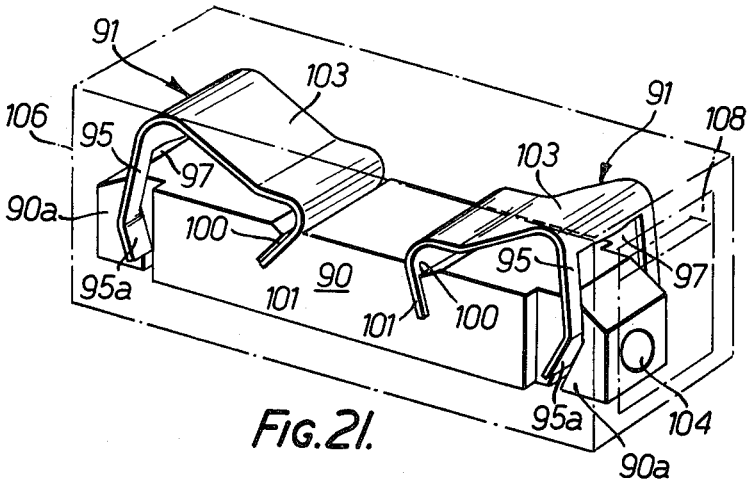
FIG. 21 shows a perspective view of a screwless terminal or connector with a contact bridge and two clamping springs held thereon under tension, and a housing of insulating material illustrated in chain line.
Figure 22:
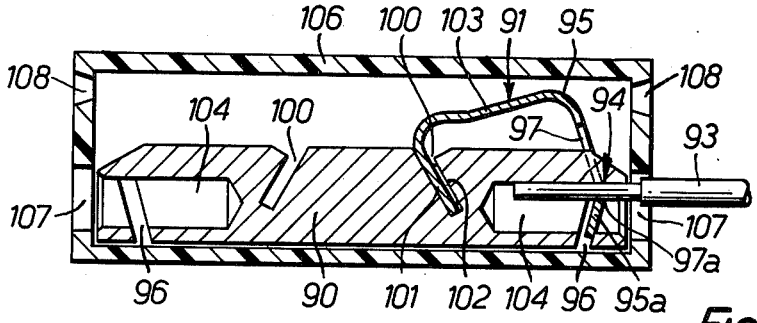
FIG. 22 shows a vertical longitudinal section through the same terminal with only one spring illustrated and with an electrical conductor connected up.
Figure 23:
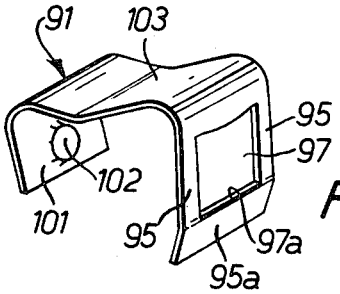
FIG. 23 shows a perspective view of a clamping spring bent into U-shape.

As illustrated in FIGS. 21 and 22 of the drawing, an electrical conductor 93 can be detachably connected up from each end of the contact bridge 90. There is also the possibility, however, of slitting the clamping springs 91 in the region of their clamping arm 95 so that two clamping-spring arms 95 are present, disposed side by side, and each clamping-spring arm 95 is equipped with a recess 97 and clamps an electrical conductor 93 to the contact bridge 90, which renders possible a connection of two conductors 93 to one end of the contact bridge 90. In this case, the contact bridge 90 likewise has two insertion openings 104 extending side by side at the end.

FIG. 24 discloses a further embodiment of a terminal. In this case, the clamping springs 91, which were previously separate, are united in a one-piece clamping spring 92. This clamping spring 92 is bent into the shape of an M and has two clamping arms 95 at the ends. In the central region, this clamping spring 92 has a U-shaped securing formation 92*a* with which it is located in the groove 105 in the contact bridge 90.

This securing formation 92*a* may be forced or pressed into the groove 105 or may be located on the contact bridge 90 by a detent connection.

Disposed round the contact bridge 90 with the clamping springs 91 or clamping spring 92 is a housing 106 of insulating material with conductor insertion openings 107 at the ends and release apertures 108, which is constructed solely as a protective housing and does not receive any contact pressure from the bridge 90 and the springs 91, 92.

The slot 100 or the groove 105 forms a holder for the spring 91, 92. As a further embodiment of this holding means, the clamping springs 91, 92 can be secured to the contact bridge 90 by plug-in, rivet, screw, welding or detent connection.

According to FIGS. 25 to 29, a terminal housing for electrical line-up terminals to be located to form a block on a supporting rail 111 is designated by 110. Each terminal housing 110 has a projecting retaining dog 115 on the one terminal-housing contact face 113, in the region of its end edge 110*a* and a retaining recess 116 which is open at the end edge at the opposite terminal-housing contact face 114; adjacent terminal housings 110, which bear against one another with their contact faces 113, 114 can be connected to form a block 112 by a pivotal movement effected transversely to the longitudinal direction of the supporing rail 111 with detachable interengagement of the retaining dog 115 and of the retaining recess 116 in one another, in the longitudinal direction of the supporting rail and each individual housing 110 can be detached from this block 112 again by pivoting.

The retaining dog 115 and the retaining recess 116 extend above the supporting rail 111 and extend in an arc (in the form of part of a circle) round a pivot point 117 of the terminal housing 110 from the end edge 110*a* transversely to the longitudinal direction of the rail towards the centre of the housing so that the pivotal connection is rendered possible by this arcuate course of the two interengaging parts 115, 116.

The retaining dog 115 ends flush with the end edge 110*a* at the outside and extends over a portion of the housing width extending transversely to the longitudinal direction of the rail, in the form of a web, being raised to an equal extent from the contact face 113 over its whole length—the dog 115 has an arcuate shape in the longitudinal direction (rib shape).

The retaining recess 116 likewise extends in the form of an arc in the longitudinal direction and is taken from the end edge 110*a* into the housing where it has a length at least equal to the dog 115 and is open at the contact face side in the form of a groove. The retaining dog 115 engages at least substantially positively in the retaining recess 116 and both parts 115, 116 preferably have an undercut cross-section affording the block connection in the longitudinal direction of the supporting rail.

As illustrated in the drawing, the dog 115 and the recess 116 each have a dovetailed (trapezoidal) cross-section and the upper cross-sectional face extends obliquely downwards and towards the contact surface 113, 114 in the form of a holding surface 115*a*, 116*a*.

In a further form of embodiment, not illustrated, the dog 115 and the recess 116 are made in the form of part of a circle or oval in cross-section in order to form the undercut cross-section. There is the further possibility of making the dog 115 and the recess 116 stepped in cross-section so that they form angle members.

A detent 118 is provided on the retaining dog 115, preferably rising on the upper, oblique and/or arcuate holding surface 115*a* and extending in the central longitudinal region of the dog 115, and this detent 118 may occupy a portion or the whole width of the dog 115. In the connected position of the housings, this detent 118 cooperates with a detent recess 119 in the retaining recess 116.

The pivot point 117 of the terminal housing is formed by the lower edge of a groove 120 in the terminal housing 110 and cooperates with the supporting rail 111.

The supporting rail 111 is preferably formed from a U-rail and its two upwardly directed U-arms form supporting strips 111*a* which are bent outwards at an angle at the free end and on which the terminal housings 110 can engage with two opposite grooves 120.

Each terminal housing 110 is constructed in the form of a one-piece housing of plastics material and the retaining dogs 115 and the retaining recesses 116 are formed during production.

The location and release of the terminal housings 110 on the supporting rail 111 is carried out as follows:

Each housing 110 is placed with the groove 120 situated below the dog 115 or the recess 116 on the supporting strip 111*a*, the housing 110 resting with the opposite groove 120 still above the other supporting strip 111*a* so that the housing 110 stands on the supporting rail 111 in a position inclined obliquely upwards. Now the housing 110 is pivoted about the supporting strip 111*a*, the lower edge of the groove with the supporting strip 11*a* forming the pivot point 117 and as a result the housing 110 is swung downwards with the opposite region and the housing 110 engages with its second groove 120 in the supporting strip 11*a* situated opposite the pivot point 117.

During the downward pivoting, the dog 115 simultaneously moves into the groove 116 and in the secured position the detent 118 is also engaged in the detent recess 119 so that adjacent terminal housings 110 are connected to one another in the longitudinal direction of the rail by the recess 116 and the dog 115 and are located on the supporting rail transversely to the longitudinal direction by the grooves 120 engaging over the supporting strips 111*a*.

Any desired number of terminal housings 110 can be connected to form a block 112 on the supporting rail 111.

If a terminal housing 120 has to be detached, in which case it may be the outermost one or a middle one or any individual one, then this housing 110 is pivoted upwards about the pivot point 117 while the groove 120 situated opposite the pivot point 117 is pivoted away from the supporting strip 111*a* and at the same time the dog 115 is pivoted out of the groove 116 of an adjacent housing 110 and the groove 116 is pivoted out of the dog 115 of the other adjacent housing and so the connection is released. When the parts 115 and 116 have separated, the required terminal housing 110 can be removed from the supporting rail 111.

After repair or other electrical or mechanical work or the like, the same housing or a fresh one can be reinserted in the place from which the housing 110 was removed, without the other housings 110 having to change their position—the housing 110 is again pivoted in between the housings 110—as previously described—and the recess 116 and the dog 115 again establish the block connection with the adjacent housings 110.

The two grooves 120 are each provided in a housing foot 121, are situated opposite one another and are open at the inside of the foot (the sides of the feet adjacent to one another). The two feet 121 render possible an outward widening as a result of which the engagement of the terminal housing 110 on the supporting rail 111 is possible.

What is claimed is:

1. An electrical bridging connector (10) for electrically connecting a pair of adjacent generally parallel conductive contact members (14) each contained within a separate insulated housing (11), respectively, said housings being mounted on a common support (22), comprising (a) a conductive U-shaped bridge member (10) extending between, and arranged with its axis extending parallel with the axes of, said contact members, said bridge member including a pair of parallel arm portions (12) extending in electrical engagement within openings contained within adjacent portions of said contact members, respectively, said bridge member also including a transverse portion (16) connecting said arm portions at one end; and (b) a handle head member (17) formed of insulating material and mounted on said bridge member transverse portion, whereby upon manual grasping of the handle head member, the bridge member may be inserted in electrical engagement between, or removed from engagement with, said pair of contact members.

2. Apparatus as defined in claim 1, wherein each of said contact member conductive arm portions is resilient and contains a generally longitudinally extending opening.

3. Apparatus as defined in claim 2, wherein the longitudinal edges (12*a*) of said arm portions are convexly curved outwardly to produce the resilient effect, said opening being provided with opposite and inwardly directed abutments (21) for limiting the resilient effect.

4. Apparatus as defined in claim 3, wherein said contact member openings comprise opposed grooves (13) for receiving said bridging member conductive arm portions, respectively.

5. Resilient electrical connector means for clamping an electric conductor beneath a terminal of a separate contact bridge formed as an abutment, comprising a spring member (48) of generally tubular configuration including a first portion (48*b*) extending parallel with said contact bridge and connected against longitudinal displacement relative thereto, said spring member including a second portion (48*c*) arranged at an angle relative to said contact bridge, said second portion containing a conductor-receiving opening (48*e*).

6. Apparatus as defined in claim 5, wherein said first portion extends through said opening (48*e*) of said second portion and terminates in a bent portion (48*a*) which extends toward said contact bridge member.

7. Apparatus as defined in claim 6, wherein said contact bridge is provided with a recess (44*c*) for receiving said spring member bent portion.

8. Apparatus as defined in claim 7, wherein said spring member second portion (48*c*) includes spring means (48*g*) that defines a clamping edge adjacent the contact bridge, wherein said clamping edge is directed toward the recess contained in said contact bridge.

9. Apparatus as defined in claim 8, wherein said spring terminal has a central portion of generally M-shaped configuration, said contact bridge having a generally U-shaped cross-sectional configuration.

10. Apparatus as defined in claim 5, wherein the contact bridge is arranged within a housing formed from insulating material and mounted on a fixed mounting rail (59,60); and further including ground bridge means (68) for connecting said contact bridge with ground, said ground bridge means containing a clamping groove (70,71) for receiving a marginal portion of said mounting rail.

11. Apparatus as defined in claim 10, and further including flat spring means (72,73) mounted in said clamping groove for resisting displacement of said ground bridge means relative to said mounting rail.

12. Apparatus as defined in claim 10, wherein said mounting rail includes resilient marginal rail portions (59*a*, 60*a*).

13. Connector means for electrically connecting the ends of a pair of conductors, comprising (a) a contact bridge member (90) containing at opposite ends openings (104) for receiving said conductors, respectively; and (b) claimping spring means (91,92) for clamping said conductors in said openings, respectively, said clamping spring means including at each end of said contact bridge member (1) a resilient U-shaped portion arranged on one side of said contact bridge member, said U-shaped portion including a first arm portion (101,105) spaced from the associated end of said contact bridge member and connected against longitudinal displacement relative thereto, said U-shaped portion also including a second arm portion (95) containing an opening (97) receiving the associated end portion of said contact bridge member;

(2) the other side of said contact bridge member containing a slot (96) communicating with the associated conductor-receiving opening, the free end (95*a*) of said second arm portion extending within said slot to retain a conductor within the conductor-receiving opening.

14. Apparatus as defined in claim 13, wherein said clamping spring means includes two separate U-shaped clamping springs (91), the first arm portions (101) of said springs extending within corresponding slots (102) contained in said contact bridge member, respectively.

15. Apparatus as defined in claim 13, wherein said clamping spring means comprises a resilient unitary member (92) including a connecting portion (92*a*) that connects the extremities of said first arm portions of said U-shaped portions, said first arm portions and said connecting portion extending within a corresponding recess contained in said one surface of said contact bridge member.

16. An electrical connector assembly, comprising (a) a plurality of terminal housings (110) each formed of insulating material and containing a conductive contact bridge member having at each end a conductor-receiving opening, and clamping spring means for retaining conductors in said openings, respectively; and (b) a mounting rail (111) having longitudinally extending marginal flange portions;

(c) each of said housings including foot-like extensions (121) adapted for cooperation with one of said marginal flange portions to define a pivot axis (117) extending longitudinally of said mounting rail, thereby to permit the housing to be pivoted about said one marginal flange portion toward a mounted position on, and extending transversely of, said rail; and (d) retaining dog and recess means (115,116) releasably connecting said housings together against longitudinal displacement relative to said mounting rail.

17. Apparatus as defined in claim 16, wherein said retaining dog and recess means are arranged between adjacent surfaces of successive housings, said retaining dog and recess means having cooperating arcuate surfaces the centers of curvature of which are contained on said pivot axis.

* * * * *